United States Patent [19]

Kim et al.

[11] 4,334,924

[45] Jun. 15, 1982

[54] PYROMETALLURGICAL OXIDATION OF MOLYBDENUM RICH MATTE

[75] Inventors: Jonathan J. Kim, Chelmsford; Paul R. Ammann, Boxford, both of Mass.

[73] Assignee: Kennecott Corporation, Stamford, Conn.

[21] Appl. No.: 216,655

[22] Filed: Dec. 15, 1980

[51] Int. Cl.[3] ..... C22C 33/00

[52] U.S. Cl. ..... 75/133.5; 75/24; 420/581; 420/582

[58] Field of Search ..... 75/24, 133.5, 134 C

[56] References Cited

U.S. PATENT DOCUMENTS 2,135,630 11/1938 Sullivan ..... 75/133.5

3,857,699 12/1974 Ammann et al. ..... 75/24

3,857,700 12/1974 Ammann et al. ..... 75/74

*Primary Examiner*—M. J. Andrews

*Attorney, Agent, or Firm*—John L. Sniado; Anthony M. Lorusso

[57] ABSTRACT

Molten molybdenum-(copper)-iron-sulfur mattes or alloys, obtained for example, by reacting slags or other molybdenum containing oxide residues or waste materials with an iron and/or sulfide reductant, are enriched in molybdenum and copper (if present) by a pyrometallurgical process. The molten matte or alloy material is oxidized to remove sulfur, as sulfur oxides, while varying amounts of iron are converted to iron oxides which separate from the metallics. The oxidation thus enriches the molybdenum and copper content of the remaining alloy. Silica flux may be added during the reaction process to form a fluid slag with the iron oxide which separates from the remaining molybdenum-iron-(copper) material which constitutes the product.

8 Claims, 2 Drawing Figures

PYROMETALLURGICAL OXIDATION OF MOLYBDENUM RICH MATTE

BACKGROUND OF THE INVENTION

Often, slags or metallic residues produced in smelting operations contains molybdenum in concentrations sufficient to provide an economic incentive for its recovery. This is particularly true of various copper smelting slags. Generally, the molybdenum present in the slag is due to inefficiencies in the flotation step for separating molybdenite from copper sulfide minerals prior to the smelting step. (Other slags such as steel slags may also contain molybdenum).

Analysis of some typical copper reverberatory slags shows that the molybdenum is dispersed throughout the glassy iron silicate phase. Standard selective leaching processes cannot be used to recover and isolate the metal values in these slags because the iron silicate is inert to dilute acids and caustic solutions. Concentrated caustics and acids will dissolve the slag with an uneconomical consumption of reagent.

An extraction process to concentrate molybdenum from slags has been described in U.S. Pat. No. 3,857,699 to Paul R. Ammann et al. entitled "Process for Recovering Non-Ferrous Metal Values from Reverberatory Furnace Slags" the teachings of which are incorporated herein by reference. An important step in that process utilizes the preferential solubility of molybdenum in an iron-sulfur matte. Thus, the molybdenum in the molten slag is extracted into a molten iron sulfide matte from which it is recovered.

As is taught in that patent, after oxidizing (roasting) the matte, final recovery of the molybdenum is accomplished hydrometallurgically by leaching the matte to produce a pregnant liquor and then selectively extracting the molybdenum values from the pregnant liquor.

A major disadvantage of hydrometallurgical recovery processes is that the cost per pound of molybdenum becomes high when the matte or alloy contains low concentrations of molybdenum (e.g., less than 10%).

In practicing this invention, a molybdenum-rich molten matte (or alloy) is contacted with air or oxygen-enriched air. During the oxidation, intimate contact must be maintained between the matte (alloy) and slag to avoid significant oxidation and loss of molybdenum. At this point it should be noted that the term "matte" connotes a predominantly sulfide material while the term "alloy" connotes a predominantly metallic material which may contain small amounts of sulfur. Both mattes and alloys are treatable by the present invention.

By oxidizing iron and sulfur throughout the molten matte or alloy in accordance with the present invention, iron and sulfur are selectively oxidized and separate from the remaining molybdenum-iron (-copper) phase. The iron oxides separate as an immiscible slag while the sulfur separates as gaseous sulfur oxides.

The major advantages of the present process over the known prior art processes include improved economics which is the result of utilizing the molten matte or alloy directly as a liquid, the relatively low cost of reagents, energy and operating labor.

Accordingly, an object of the present invention is to provide an economical process for upgrading molybdenum mattes or alloys.

Another object of this invention is to use relatively low cost pyrometallurgical oxidation, under controlled conditions, to concentrate the molybdenum in mattes or alloys. The concentrated or enriched matte (or alloy) may then be refined into a finished or salable molybdenum product either by hydrometallurgical processing or by further pyrometallurgical treatment.

SUMMARY OF THE INVENTION

These and other objects of the invention are accomplished by a process wherein the molybdenum in the molten alloy or matte is enriched by oxidizing the molten matte with air or oxygen. During treatment, sulfur is oxidized and thus is removed as a gas while iron is oxidized and forms an iron slag phase which separates from the molybdenum material which contains molybdenum, iron, and copper and constitutes the product.

It is stressed that this invention describes a process for securing molybdenum rich materials in an economic manner from a molybdenum rich matte or alloy which in turn may have been produced from a slag or other solid metal oxide material. The refinement of the end products into elemental molybdenum or other utilization of the end products of this process may be accomplished by methods well known to the metallurgical arts.

DESCRIPTION OF THE PREFERRED EMBODIMENTS

At the outset the process of the present invention is described in its broadest overall aspects with a more detailed description following. The present invention is a pyrometallurgical process for treatment of molten mattes or alloys containing non-ferrous metal values such as molybdenum and copper which are treated to enrich their copper and molybdenum content. Such mattes usually are obtained after extracting the molybdenum and copper in molten smelter slags into an iron sulfide reductant as is described in U.S. Pat. No. 3,857,699 to produce a molybdenum containing alloy or matte. Of course, the source for producing the matte or alloy may be other oxidic molybdenum bearing materials such as fumes and dusts from smelting operation. The process of the present invention includes treating the molybdenum containing mattes in such a way as to cause molybdenum and copper metal concentration in the matte to increase without loss of these metal values. The upgraded molybdenum-bearing phase is then separated from the remaining non-molybdenum iron slag material. It should be noted that the phase formation reaction of the present invention concentrates the molybdenum values of the molten matte while the iron oxide or slag phase which forms is substantially free of molybdenum.

In one method used to produce a matte or alloy for use in the present process, molten slag is contacted with an iron-sulfide reductant to cause metal values to exchange from the slag to the matte. Thus, temperature and matte concentration ranges are disclosed at which molybdenum is soluble in an iron-sulfur matte in preference to the slag.

To obtain relatively high distribution coefficients, the iron to sulfur mole ratio in the matte is maintained between about two to one to nine to one with a matte containing a mole ratio of iron to sulfur of about two to one to three to one being preferred, and the temperature is maintained between the range of temperatures of the slag melting point (about 1050° C.) and 1600° C. The preferred temperature range for the system is between 1300° C. to 1400° C. In connection with the foregoing, the distribution coefficient of molybdenum is defined as the ratio of molybdenum concentration in the matte to the molybdenum concentration in the slag in a single stage.

Figure 1:
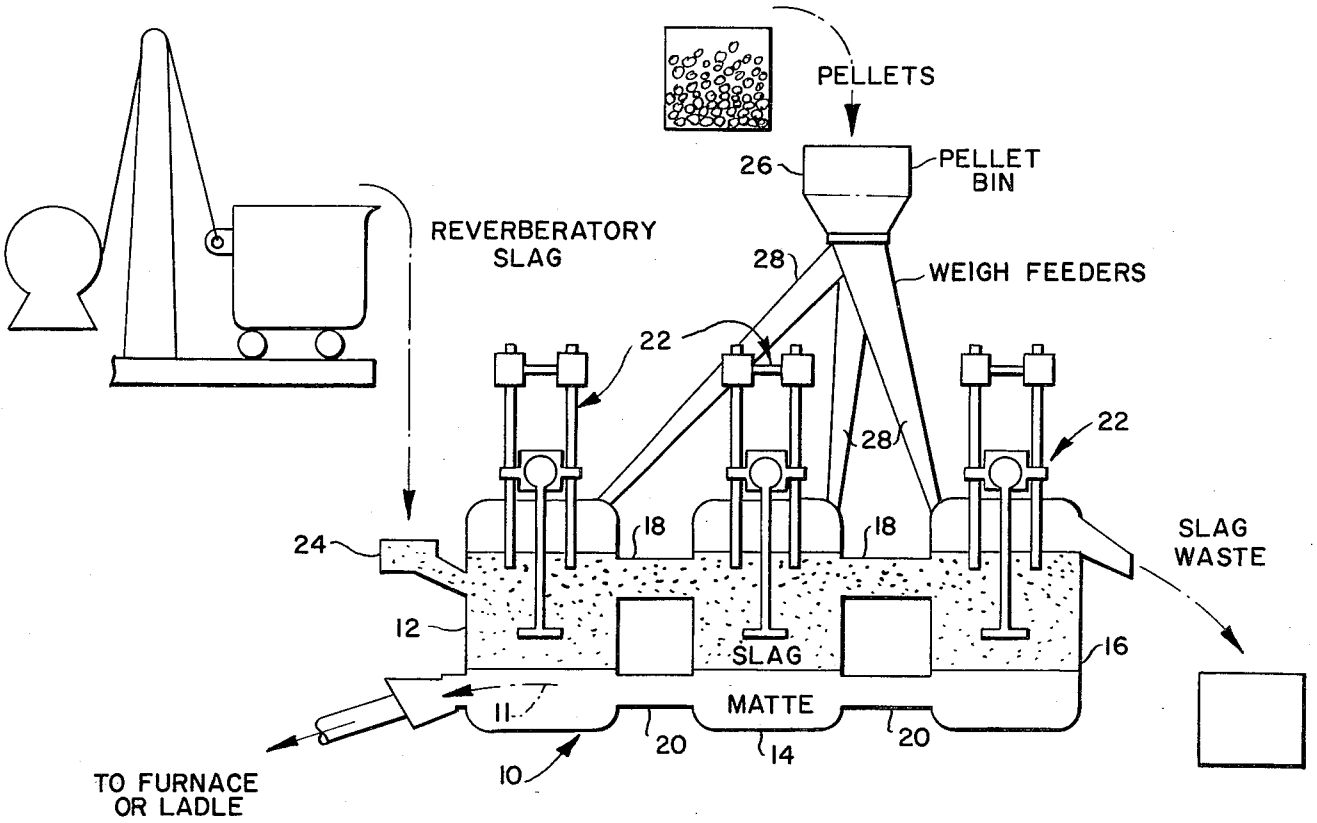
FIG. 1 is a schematic representation of a process for treating slag to produce matte; and, FIG. 2 is a schematic representation of the process for enriching the molybdenum content of matte in accordance with the present invention.

The slag and the matte may be reacted with each other batchwise in a single reactor or in a counter-current manner in a multistage reactor. The embodiment of the present invention wherein slag and matte contact each other in a countercurrent manner is best shown in FIG. 1. To accomplish such countercurrent contact, a multistage reactor 10 is used. Although three reactors 12, 14 and 16 are shown in FIG. 1, as is apparent, two reactors can be utilized, or, indeed, more than three reactors can be utilized. Reactors 12, 14 and 16 are connected in series by upper and lower conduits 18 and 20.

As is shown in FIG. 1, lower conduits 20 allow a flow of matte from one reactor to another; whereas, upper conduits 18 allow a flow of slag from one reactor to another. It is preferrable to stir the contents of the reactor with a stirrer assembly 22. Stirrer assembly 22 may be a water cooled mechanical stirrer having copper blades as is shown in U.S. Pat. No. 3,857,699. It is emphasized, however, that the particular scheme used to increase contact between the slag and the matte forms no part of the invention. For example, the matte may be agitated into the slag by injecting a neutral gas such as nitrogen into each reactor by means of a lance.

Slag is introduced into slag treatment reactor 10 by being poured into a launder 24 located on reactor 12. Other constituents in reactor 10, such as iron pyrites, iron and sulfur, are added to reactor 10 by means of a feed bin 26 which has launders 28 which distribute materials to reactors 12, 14 and 16. The three slag treatment reactors 12, 14 and 16 connected in series were determined to provide products with high molybdenum contents and overall process flexibility. To handle 66 tons per hour based on slag feed rates, each unit 12, 14 and 16 must be able to contain 22 tons of slag. Each reactor 12, 14 and 16 holds a maximum of 15 tons of matte product. The matte is generated continuously in each furnace, and once each shift, the matte is tapped off from first reactor 12 into which the slag is fed. Only half of the matte is tapped at any one time.

As is set forth above, the slag treatment product can contain molybdenum, copper and other non-ferrous metal values. To recover these values, the slag treatment product, represented by arrow 11, is drawn off separately from the slag and is delivered to a furnace or ladle such as that shown in FIG. 2 to upgrade its molybdenum and copper content.

Figure 2:
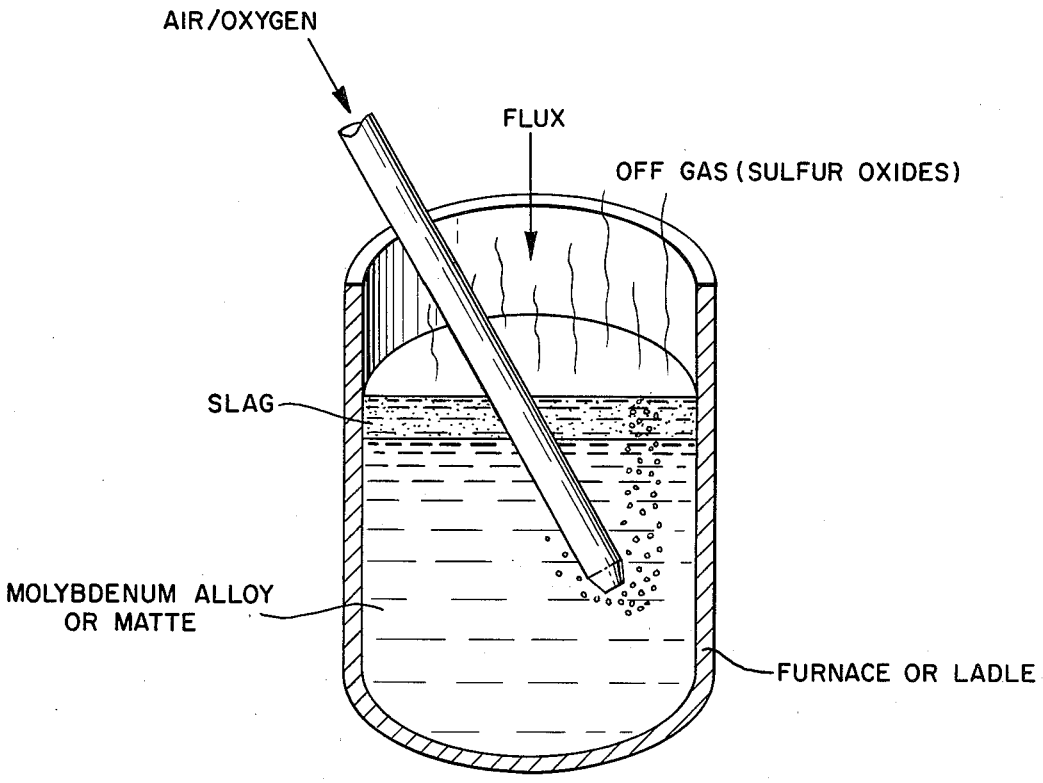

At this point, it should be noted that alloys or mattes which can be treated in accordance with the present invention are producible from sources other than slag. As mentioned above, oxide molybdenum containing dusts produced during smelting can be used to produce mattes which are treatable by the present process. By oxidizing mattes or alloys having molybdenum and iron, the metallic content of the slag is enriched no matter what the source of the matte or alloy might be. Thus, as is shown in FIG. 2, air or oxygen is blown into the matte or alloy in the ladle or furnace while the matte is molten to selectively oxidize the iron and sulfur. Although FIG. 2 shows oxygen being blown into the molten matte or alloy through a lance which is submerged in the matte or alloy, it should be noted that there are many ways known in this art for adding oxygen to molten metallic materials such as the alloy or matte being treated. The use of the lance shown in FIG. 2 has certain advantages in that it increases the contact between the matte or alloy and the oxygen. However, it is possible to oxidize the matte or alloy by placing it in a rotary kiln and adding the air or oxygen above the molten slag or alloy in the kiln and rotating the kiln to increase the contact of the molten matte or alloy with the air or oxygen. The air or oxygen could also be introduced into a ladle or furnace by use of a tuyere placed below the level of the matte or alloy in the furnace or ladle. Another method of adding the air or oxygen to the alloy is to use a converter reactor. Such techniques, of course, are well known in this art.

Silica flux may be added at a rate sufficient to react with the iron oxide produced to insure that the iron slag remains liquid. The silica flux is added as the matte is being treated with oxygen.

As a result of this oxidation, sulfur in the matte is oxidized to gaseous sulfur oxides. The sulfur oxide gases may be scrubbed with limestone in accordance with the procedures well known in this art. The oxidized iron immediately floats to the top of the matte. As long as there is sufficient iron in the alloy/matte phase, molybdenum will be retained in that phase. An example is shown in Table I where by oxidation, 100 pounds of matte/alloy is reduced to 65 pounds and the molybdenum concentration is enriched from 10 to 15 percent. An iron slag is generated by the iron oxide; it amounts to 62.5 pounds, but contains little molybdenum.

When the oxidation reaction is completed, the iron slag is separated from the metal alloy/matte phase. Separation may be accomplished in a number of ways. For example, the iron slag may be poured or skimmed off of the top of the furnace or ladle, or the molybdenum-rich phase may be drawn from the bottom of the furnace or ladle.

The concentration of molybdenum is increased with the extent of oxidation of the metal alloy or sulfide phase. The iron slag produced may be discarded, or if the molybdenum and copper content in the iron slag is too high, this slag may be added to other slag to be contacted with another lot of new alloy/matte in reactor 10 to lower the valuable metal content prior to discard.

TABLE I

| | Reactants | | |
|---|---|---|---|
| | Alloy/Matte (lbs/%) | Flux (lbs) | Air (lbs) |
| Iron | 70 | 0 | 0 |
| Molybdenum | 10 | 0 | 0 |
| Copper | 5 | 0 | 0 |
| Sulfur | 10 | 0 | 0 |
| Other | 5 | 0 | 0 |
| Oxygen | 0 | 0 | 16.2 |
| Nitrogen | 0 | 0 | 62.4 |
| Silica | 0 | 27 | 0 |
| TOTAL | 100 | 27 | 78.6 |

| | Products | | | | |
|---|---|---|---|---|---|
| | Alloy/Matte | | Slag | | Offgases |
| | lbs | % | lbs | % | lbs |
| Iron | 45 | 69 | 25 | 40 | 0 |

TABLE I-continued

| | | | | | |
|---|---|---|---|---|---|
| Molybdenum | 9.9 | 15 | 0.1 | 0.1 | 0 |
| Copper | 4.4 | 6.7 | 0.6 | 1 | 0 |
| Sulfur | 1 | 1.5 | 0.6 | 1 | 9 |
| Other | 5 | 7.6 | 1.8 | 3 | 0 |
| Oxygen | 0 | 0 | 7.2 | 11.5 | 9 |
| Nitrogen | 0 | 0 | 0 | 0 | 62.4 |
| Silica | 0 | 0 | 27 | 4.3 | 0 |
| TOTAL | 65 | 100 | 62.5 | | 81.4 |

As has been stated above, the present invention is directed to a process for recovering the molybdenum values from mattes or alloys. Such mattes or alloys are usually produced from many types of slags. Typically, the slags are ferrosilicate slags. High magnetic slags, that is slags containing 7 to 30% by weight magnetite, can be treated to produce a matte which in turn can be treated in accordance with the present invention to recover its molybdenum content. However, it is necessary to reduce the magnetite content of such slags prior to molybdenum extraction. Ideally, such high magnetite slags would be treated in accordance with the process set forth in U.S. Pat. No. 3,857,700 entitled Pyrometallurgical Recovery of Copper Values from Converter Slags by Ammann et al in order to remove much of the copper content of such slags. In practicing the process of that patent, the teachings of which are incorporated herein by reference, such high magnetite slags are contacted while molten with a reductant. The reductant reduces the iron oxide in the slag; thus lowering the magnetite content which in turn enables the copper in the slag to be extracted into a sulfide matte. Thus, the slag, after being treated in accordance with the procedure set forth in that patent, has a low magnetite content that is below 5% by weight and has much of its copper content removed.

In accordance with the present invention, the composition range for the oxidic starting material is set forth below.

TABLE II

COMPOSITION OF OXIDIC MATERIAL TO BE TREATED

| Constituent | Percent by Weight |
|---|---|
| FeO | 40–60 |
| $Fe_3O_4$ | (5–30) as part of FeO |
| $SiO_2$ | 20–38 |
| CaO | 0–5 |
| MgO | 0–5 |
| $Al_2O_3$ | 0–10 |
| Cu | 0–10 |
| Mo | trace (.05)–3 |
| S | 0–3 |
| impurities | 0–5 |

In more general terms the process is applicable to slags or metallic oxide materials which contain 0.05–3% molybdenum, 0–10% copper, and the remainder being comprised of FeO, $Fe_3O_4$, $SiO_2$, CaO, MgO, $Al_2O_3$, S, and impurities such as arsenic, lead and zinc.

After treatment of the slag with the iron-sulfur reductant, a matte is produced which has the following composition.

TABLE III

| Constituent | Percent by Weight |
|---|---|
| Mo | 1–30 |
| Cu | 0–20 |
| S | 2–15 |
| impurities | 0–5 |

TABLE III-continued

| Constituent | Percent by Weight |
|---|---|
| Fe | balance |

It is preferred, however, to produce mattes having the following composition,

TABLE IV

| Constituent | Percent by Weight |
|---|---|
| Mo | 10–25 |
| Cu | 0–15 |
| S | 2–10 |
| impurities | 0–2 |
| Fe | balance |

As is set forth above, after separating the matte from the slag, in accordance with the procedures set forth in U.S. Pat. No. 3,857,699, the matte is delivered to a furnace or ladle where it is treated in accordance with the present invention. The object of the treatment is to oxidize as much of the iron in the matte as is possible without vaporizing molybdenum. Typically, the matte will contain 50% to 70% iron and it is oxidized until the molybdenum concentration in the alloy reaches 15 to 25 percent, or losses to the slag or gas phase become too large. As used throughout this specification and claims all percents are by weight. During treatment by oxidation, the matte is maintained in molten condition. Typically, this will be between the range of 1250° C. to 1600° C.; although, any temperature at which the matte is molten can be utilized during the oxidation step. The amount of oxygen that is utilized is based on the stoichiometric amount needed to reduce the amount of iron in the product to the desired level. Of course, the reaction of the iron with the oxygen is exothermic.

Reaction of the iron with oxygen causes the iron to float to the top of the ladle or furnace as iron oxide where it can be separated from the molybdenum enriched product. Separation can be accomplished by any number of known techniques. For example, the molybdenum product can be simply tapped from the bottom of the furnace or the resulting iron oxide material can be skimmed off the top of the furnace. Thus, the broad concept of the invention involves merely separating the molybdenum product from the undesirable iron slag which floats on top of it. Of course, as is known in this art, the iron oxide can be slagged with silica. Silica slagging makes it easier to separate the undesirable iron oxide (iron slag) from the molybdenum.

The product that is separated from the furnace or ladle has the following composition.

TABLE V

| Constituent | Percent by Weight |
|---|---|
| Mo | up to 35% |
| Cu | 0 to 35% |
| S | 0 to 2% |
| impurities | 0 to less than 1% |
| Fe | balance |

It is preferred to produce a product having the following composition.

TABLE VI

| Constituent | Percent by Weight |
|---|---|
| Fe | 50% or less but constituting the balance |
| Mo | 20–25 |

TABLE VI-continued

| Constituent | Percent by Weight |
|---|---|
| Cu | 15–25 |
| S | 0–2% |
| impurities | 0 to less than 1% |

The final product produced by the process of the present invention is a metallic alloy which may be sold directly. Of course, if desired, the product can be treated hydrometallurgically or pyrometallurigically to produce molybdenum oxide or other chemical forms of molybdenum.

The invention may be embodied in other specific forms without departing from the spirit or essential characteristics thereof. The present embodiments are therefore to be considered in all respects as illustrative and not restrictive; the scope of the invention being indicated by the appended claims rather than by the foregoing description, and all changes which come within the meaning and range of equivalency of the claims are therefore intended to be embraced therein.

We claim:

1. A process for producing a molybdenum product from a material containing molybdenum values comprising the following steps:

(a) selecting an oxidic material that has the following composition:

0.05–3% molybdenum, 0–10% copper, and the remainder being comprised of FeO, $Fe_3O_4$, $SiO_2$, CaO, MgO, $Al_2O_3$, S, and impurities selected from the group of arsenic, lead, zinc and mixtures thereof;

(b) reacting the molten oxidic material of step (a) with an iron-sulfur reductant, said reaction being performed at a temperature between the slag melting point and 1600° C.;

(c) separating an iron sulfur matte or alloy as a reaction product from the reaction of step (b), said matte having the following composition:

| Constituent | Percent by Weight |
|---|---|
| Mo | 1–30 |
| Cu | 0–20 |
| S | 2–15 |
| impurities | 0–5 |
| Fe | balance |

(d) delivering said matte product of step (c) to a ladle or furnace and injecting oxygen into the matte in said ladle or furnace while it is molten to selectively oxidize the iron and sulfur in said matte or alloy to produce an iron slag phase and a molybdenum phase having the following composition:

| Constituent | Percent by Weight |
|---|---|
| Mo | up to 35 |
| Cu | 0–35 |
| S | 0–2% |
| impurities | less than 1% |
| Fe | balance |

and, (e) removing the molybdenum product of step (d) which separates from the iron slag phase which forms in step (d).

2. A process for producing a molybdenum product from a material containing molybdenum values comprising the following steps:

(a) selecting an oxidic material that has the following composition:

| Constituent | Percent by Weight |
|---|---|
| FeO | 40–60 |
| $Fe_3O_4$ | (5–30) as part of FeO |
| $SiO_2$ | 20–38 |
| CaO | 0–5 |
| MgO | 0–5 |
| $Al_2O_3$ | 0–10 |
| Cu | 0–10 |
| Mo | trace (.05) to 3 |
| S | 0–3 |
| impurities | 0–5 |

(b) reacting the molten oxidic material of step (a) with an iron-sulfur reductant, said reaction being performed at a temperature between the slag melting point and 1600° C.;

(c) separating an iron sulfur matte or alloy as a reaction product from the reaction of step (b), said matte having the following composition:

| Constituent | Percent by Weight |
|---|---|
| Mo | 1–30 |
| Cu | 0–20 |
| S | 2–15 |
| impurities | 0–5 |
| Fe | balance |

(d) delivering said matte product of step (c) to a ladle or furnace and injecting oxygen into the matte in said ladle or furnace while it is molten to selectively oxidize the iron and sulfur in said matte or alloy to produce an iron slag phase and a molybdenum phase having the following composition:

| Constituent | Percent by Weight |
|---|---|
| Mo | up to 35 |
| Cu | 0–35 |
| S | 0–2 |
| impurities | 0 to less than 1% |
| Fe | balance |

and, (e) removing the molybdenum product of step (d) which separates from the iron slag phase which forms in step (d).

3. A process for producing a molybdenum product from a material containing molybdenum values comprising the following steps:

(a) providing a matte or alloy having the following composition:

| Constituent | Percent by Weight |
|---|---|
| Mo | 1–30 |
| Cu | 0–20 |
| S | 2–15 |
| impurities | 0–5 |
| Fe | balance |

(b) delivering said matte product of step (a) to a ladle or furnace and injecting oxygen into the matte in said ladle or furnace while it is molten to selectively oxidize the iron and sulfur in said matte or alloy to produce an iron slag phase and a molybdenum phase having the following composition:

| Constituent | Percent by Weight |
|---|---|
| Mo | up to 35 |
| Cu | 0–35 |
| S | 0–2 |
| impurities | 0 to less than 1% |
| Fe | balance |

and, (c) removing the molybdenum product of step (b) which separates from the iron slag phase which forms in step (b).

4. The process as set forth in claim 3 wherein in step (a) a matte having the following composition is provided:

| Constituent | Percent by Weight |
|---|---|
| Mo | 10–25 |
| Cu | 1–15 |
| S | 2–10 |
| impurities | 0–2 |
| Fe | balance |

5. The process as set forth in claim 4 wherein the product that is produced in step (c) has the following composition:

| Constituent | Percent by Weight |
|---|---|
| Fe | 50% or less |
| Mo | 20–25 |
| Cu | 15–25 |
| S | 0–2 |
| impurities | 0 to less than 1% |

6. The process as set forth in claim 3 wherein a silica flux is added during the oxidation of step (b) to effect the separation of the molybdenum product from the iron slag phase.

7. The process as set forth in claim 4 wherein a silica flux is added during the oxidation of step (b) to effect the separation of the molybdenum product from the iron slag phase.

8. The process as set forth in claim 5 wherein a silica flux is added during the oxidation of step (b) to effect the separation of the molybdenum product from the iron slag phase.

* * * * *